United States Patent [19]

Trotman, III

[11] 4,189,060

[45] Feb. 19, 1980

[54] RETENTION MEANS FOR CONTAINER CLOSURE ASSEMBLY

[75] Inventor: Gladstone Trotman, III, Cottage Grove, Mich.

[73] Assignee: Minnesota Mining and Manufacturing Company, Saint Paul, Mich.

[21] Appl. No.: 948,830

[22] Filed: Oct. 5, 1978

[51] Int. Cl.[2] ..... B65D 41/02

[52] U.S. Cl. ..... 220/260; 220/269; 220/270; 220/359

[58] Field of Search ..... 220/256–258, 220/260, 269, 270, 359, 339; 229/7 R; 222/541

[56] References Cited

U.S. PATENT DOCUMENTS

| | | | |
|---|---|---|---|
| 3,442,416 | 5/1969 | Nicholson | 220/269 |
| 3,990,603 | 11/1976 | Brochman | 220/260 |

*Primary Examiner*—George T. Hall

*Attorney, Agent, or Firm*—Cruzan Alexander; Donald M. Sell; Dean P. Edmundson

[57] ABSTRACT

An improvement for restricting the separation of an easy-open, closure system from a container, the improvement being a nonmetallic film (preferably having yarns therein) which anchors the closure system to the container end.

7 Claims, 4 Drawing Figures

RETENTION MEANS FOR CONTAINER CLOSURE ASSEMBLY

BACKGROUND OF THE INVENTION

This invention relates to closure assemblies for beverage containers. More particularly, means for restricting the removal of closure of sealing assemblies, especially flexible, tape-based closure assemblies, from container is provided.

Legislative mandate has recently motivated the development of various systems which restrict or prevent the removal of container closure or sealing assemblies from containers (e.g., metal cans). These recently developed systems generally employ metal bands, e.g., as described in U.S. Pat. No. 3,847,300 (Waters) or selectively scored or weakened container tear portions which have been constructed so that at least a portion thereof is firmly attached to the container. These systems which rely upon metallic connecting means suffer the disadvantage that they permit removal of the closure assembly from the container, e.g., by multiple flexing of the metallic connecting means until it breaks. Once the sealing assembly has been removed, it may be carelessly discarded into the environment.

A particularly advantageous container sealing assembly or closure system is that disclosed in U.S. Pat. No. 3,990,603 (Brochman). The Brochman sealing assembly employs an exterior type and an interior sheet material exteriorly and interiorly disposed circumjacent (i.e., over and surrounding) a performed opening in a beverage container. Separation of this tape closure assembly from a container may be accomplished when the assembly is improperly used, such as by exerting a continuing removal force against the exterior tape after the container has been opened.

The present invention provides an improved closure system which is extremely difficult to remove completely from a container.

SUMMARY OF THE INVENTION

The present invention provides a novel means for restricting the separation of a closure assembly from a container.

In one aspect, the present invention provides an end portion for a container, said end portion being of the type having a closure system thereon comprising a tap detachably secured to the top of said end portion over a pour hole, wherein the improvement comprises a metallic flexible film (preferably having thereon flexible yarns having total Denier of at least 250) the film having a first end and a second end, wherein said first end is bonded to the underside of said end portion and said second end is bonded to the underside of said tape in the area of said pour hole.

In another embodiment the improved end portion comprises a closure assembly comprising an exterior tape and interior sheet material.

The term "yarns" as used herein includes monofilament or multiple filament polymeric fibers. "Flexible" as used herein means that the film is capable of being multiply bent back upon itself without breaking. The term "total Denier" as used herein means the product of the number of flexible yarn times the linear density (Denier) of such yarns.

BRIEF DESCRIPTION OF THE DRAWINGS

The present invention is described in more detail hereinafter with reference to the accompanying drawings wherein like reference characters refer to the same element in the several views and in which.

DETAILED DESCRIPTION OF THE INVENTION

The preferred embodiment of the present invention as illustrated in FIGS. 1–4 employs an exterior tape and an interior sheet material which are described in detail in U.S. Pat. No. 3,990,603 (Brochman) incorporated herein by reference, and a non-metallic flexible film retention means having therein flexible yarns having total Denier of 8,000.

Figure 1:
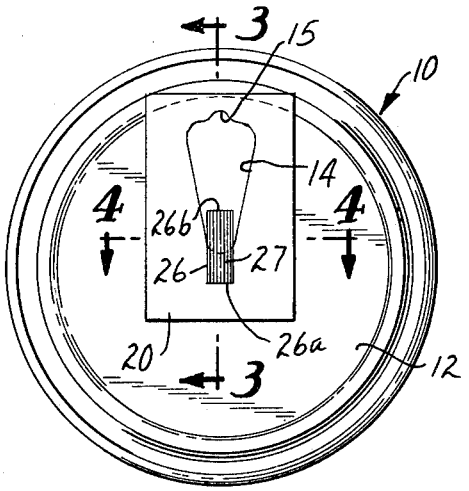
FIG. 1 is a bottom view of one embodiment of the present invention.
Figure 2:
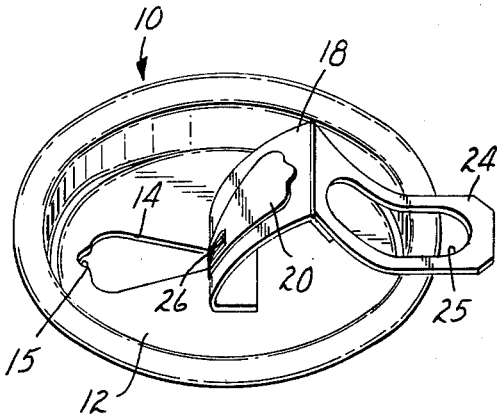
FIG. 2 is a perspective view of the invention depicted in FIG. 1 after opening.
Figure 3:
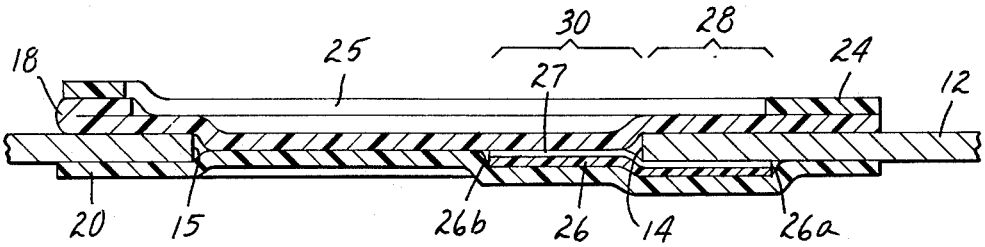
FIG. 3 is a cross-sectional view of the invention depicted in FIG. 1, taken along line 3—3.
Figure 4:
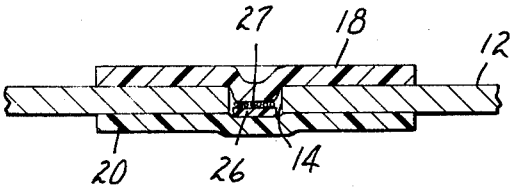
FIG. 4 is a cross-sectional view of the invention depicted in FIG. 1, taken along line 4—4.

Thus, in FIGS. 1 and 2, there is shown an end portion 10 for a container (e.g., a metal beverage can) comprising a generally circular rigid disc or lid 12 having therein a pre-formed opening or pour hole 14, the pour hole 14 having a pressure relief opening comprising a protuberance 15 on the leading edge of, and contiguous, with the pour hole 14. In this embodiment of the invention, the closure assembly comprises an exterior tape 18 and an interior sheet material 20, the exterior tape 18 and interior sheet material 20 being exteriorly and interiorly disposed circumjacent pre-formed opening 14 the interior sheet material 20 being aggressively adhered to exterior tape 18 in the area of the pour hole 14 to provide a beverage container closure assembly capable of containing pressurized beverages. Attached to the end of exterior tape 18 is a tab 24 optionally having therein a finger hole 25, the tab being designed so as to permit gripping by the fingers.

The container is opened by gripping the tab 24 and pulling the exterior tape 18 back across the pre-formed opening (toward the following edge of opening 14) and away from the end portion 10, resulting in the opened container configuration shown in FIG. 2. As the exterior tape is pulled back, the interior sheet material 20 in the area of opening 14 remains adhered to exterior tape 18 and is stripped cleanly out of said opening to provide access to the contents of the container.

A preferred embodiment of the present invention as illustrated in FIGS. 1 through 4 comprise a non-metallic flexible film 26 having thereon flexible yarns 27, the flexible film having a first end portion **26*a* bonded to the underside of the container end portion 10, at area 28, the second end portion 26*b* of the flexible film being bonded to the underside of exterior tape 18 at area 30 as well as being bonded (in the embodiment) to interior sheet 20 in the area of the pour hole 14. In the preferred embodiment, eight 1000 Denier yarns each having therein 192 monofilaments of polyethylene terephthalate (PET) are employed, thus producing a total Denier of 8,000. (Such yarns are commercially available from E. I. Du Pont de Nemours and Company under the trade designation "Dacron".) It has been found that in order to achieve measurable retention of a container closure system e.g., an exterior tape, to a container a minimum total Denier of the yarns secured to the flexible film 26** is about 250 with a total Denier of at least 1,000 being preferred.

After the container is opened as described above, continued exertion of removing force by means of the grip tab 24 in the absence of the present improvement may eventually cause exterior tape 18 to be completely removed from container end portion 10. When the present improvement is employed, the exterior tape 18 is removed to a point where the yarns and film are engaged in tensile (FIG. 2). From this point further removal of the exterior tape 18 is restricted until the yarns and film break or the adhesive anchoring the filaments to the container end portion and the exterior tape releases.

The preferred location of the improvement of the present invention is such that after the container has been completely opened, the continued removal of the closure assembly (e.g., exterior tape and interior sheet material) would apply tensile force (i.e., removing force parallel to the plane of the container portion to which the retention means is anchored) rather than peel force (i.e., removing force perpendicular to the plane of the container end portion to which the retention means is anchored). The use of a flexible retention means herein permits the removing force to be directed so as to be in tensile with respect to the container anchored first end portion **26*a*** of the retention means even though the actual direction from which the removing tensile force is exerted may (in the present embodiment) vary between 40° and 180° with respect to the first end portion of the retention means. The precise location of the present improvement will vary depending upon the type of a closure assembly used. For purposes of convenience it is generally preferable for the closure assembly to be centrally anchored to the underside of a container end portion such as herein depicted.

The ability of the present invention to restrict separation of a container closure assembly and the container thereby closed is increased if the improvement can be more aggressively bonded or anchored to both the container and to the closure assembly. A more aggressive bond between the retention means and a closure assembly or a container is generally achieved if the area in which the retention means and the closure assembly or container are bonded is increased.

A flexible film not having flexible yarns thereon has been employed in the present invention as means for retaining a closure assembly to a container. Such films advantageously anchor the closure assembly because, as discussed above, the maximum bonding area between the retention means, the container, and the closure assembly is achieved. The only limitation on the width of the film (in this embodiment) is the width of the pour hole from which the film projects. Films which have been found to be useful are the tough, high tensile strength, highly oriented films including polypropylene and polyurethane. Such films preferably have a profile (i.e., thickness) in the range of about 0.3 mil (8 micrometers) to about 10 mil (250 micrometers) and a break strength in the range of about 2.2 lbs/inch width (0.4 kg/cm width) to about 20 lbs/inch width (3.6 kg/cm width). The use of films as retention means suffers a drawback in that even very small nicks or cuts on the long dimension of a sheet of film tends to cause the film to tear. In the context of a sheet of film being bonded to the interior of a container and projecting through the pour hole of such a container, there is considerable opportunity for the edge of such a film to come in contact with a raw metal edge and be cut. For the reason that films retention means tend to be sheared, they are not preferred in the practice of this invention.

To take advantage of a film retention means (i.e., maximum anchoring of the closure assembly) and to avoid the possibility that such films may be sheared by the sharp metal edges to which they may be exposed, the most preferred embodiment of the present invention comprises non-metallic flexible films having bonded thereto essentially parallel to the longest dimension of at least one non-metallic, flexile yarn having a total Denier of greater than about 250, the film, with yarn bonded thereto, being bonded to the closure assembly and to the container so as to restrict separation thereof. The yarns which are bonded to the film tend to add tensile strength to the retention means in addition to serving to arrest the transverse propagation of tears initiated by the sharp, raw metal edges of the performed opening. Yarns permit the use of films having lower tensil strength and which are more prone to tearing. Representative yarns or fibers include rayon fiber commercially available from FMC Corporation under the trade designation "Avitex", polyarimides commercially available from E. I. du Pont de Nemours & Company under the trade designation "Kevlar", nylon 6 fibers, polyethyleneterephthalate fibers, acrylic fibers commercially available from E. I. du Pont de Nemours and Company under the trade designation "Orlon". Other fibers having the required characteristics are known in the art.

Representative films to which the representative yarns may be bonded in the practice of the present invention include 1,4-cyclohexylenedimethylene terephthalate/isophthalate copolymer (commercially available from Eastman Kodak Company under the trade designation "Kodak A150"), polypropylene, polyethylene, polybutylene, polyvinylidene chloride (commercially available from Dow Chemical Company under the trade designation "Saran"), polycarbonate (commercially available from General Electric Company under the trade designation "Lexan"), polytetrafluoroethylene (commercially available from E. I. du Pont de Nemours and Company under the trade designation "Teflon"), condensation polymer films such as polyimides and polyurethanes, cellulose ester films such as cellulose acetate and other films commonly used in the polymer art. Generally the thickness of the films found to be useful herein falls in the range of about 0.5 mil (13 micrometers) to 6 mil (150 micrometers). Additionally, the filaments should be bondable to the film employed. As a general matter, the more filaments employed and the tougher the film to which the filaments are bonded, the greater the ability of the improvement to restrict separation of the closure assembly and the container. A particularly preferred combination of yarns and films is eight 1000 Denier PET yarns with a 0.5 mil PET film backing.

In a practice of the present invention, four 1000 Denier PET yarns ("Dacron") (a total Denier of 4,000) are grouped together so as to be approximately parallel to the longest dimension of a 9/16 inch (1.4 cm) long, ¼ inch (0.6 cm) wide, 0.5 mil (13 micrometers) polyethylene terephthalate (PET) film substrate. Such PET film substrates are commercially available from 3M Company under the trade designation "Scotchpar". If an oriented film having anisotropic tensile strength is employed as the substrate, then the film should be arranged so that the strongest dimension is roughly coaxial with the yarns. The filaments and film substrate are preferably coated with a thermoplastic adhesive such as polyester polyether block copolymer, commercially available from E. I. du Pont de Nemours & Company under the trade designation "Dyvax PB-722" to a coating weight of about 0.4 mg/in$^2$ (0.06 mg/cm$^2$) and placed in an oven maintained at 200° F. (93° C.) for about 10 minutes to vaporize solvent from the adhesive.

Alternatively, a pressure sensitive adhesive such as that described in British Pat. No. 1,177,675, incorporated herein by reference, may be coated onto film and/or filaments from a suitable volatile solvent. One end of the adhesive coated filaments and film forming the retention means is then placed, for example, internally adjacent the following edge of a pour hole in a container end as illustrated in FIGS. 1 and 2, the composite film and filaments projecting into the area of the pour hole a distance of approximately ¼ inch (0.64 cm). The exterior tape and interior sheet material now applied to the container end (e.g., by pressing at 80 psi (56 kilopascals), 350° F. (175° C.) for 7 seconds) and bonded to each other and to the area surrounding the performed opening as described in U.S. Pat. No. 3,990,603, (Brochman), the retention means being located between the exterior tape and the interior sheet material and being bonded to both, in addition to being bonded to the interior of the container.

The force required to remove completely various container closure assemblies from a container thereby closed (such as that assembly container depicted in FIGS. 1 and 2) was measured employing a "Instron" tensile tester, a crosshead separation speed of 10 inches per minute (25 cm/min) and a peel angle of 130° with respect to the container end portion 10. The force required to separate the container end portion from its closure assembly, i.e., the removal force imparted by the retention means is discussed in the following examples which should not be construed so as to limit the scope of the invention.

EXAMPLE 1

Eight 1,000 Denier polyethylene terephthalate yarns each comprised of 192 monofilaments (commercially available from E. I. du Pont de Nemours and Co. under the trade designation "Dacron") and primed with a phenyl terminated polycarbodiimide primer (described in U.S. Pat. No. 4,060,664 incorporated by reference herein) were grouped so that the axes of the yarns were parallel with the longest dimension of a 3.5 mil (87 micrometer) thick uniaxially oriented polytetramethylene terephthalate film (a polyester film commercially available from the Tennessee Eastman Chemical Company under the trade designation "Tenite"). The primed filaments on the polytetramethylene terephthalate substrate were coated from a dichloromethane solution having 12 weight percent solids to a dried coating weight of 0.4 mg/in$^2$ (0.06 mg/cm$^2$) with a linear segmented thermoplastic blockcopolyester adhesive comprised of terephthalic acid, isophthalic acid, 1,4-butane diol and a polytetramethyleneether glycol having a molecular weight of about 2,000, the adhesive being commercially available from E. I. du Pont de Nemours and Company under the trade designation "Dyvax PB-722".

The adhesive coated filaments and substrate were dried in an oven at 200° F. (93° C.) for 10 minutes, after which several ½ inch (1.2 cm)×¼ inch (0.64 cm) sections were cut therefrom and then bonded to a beverage container end preheated to 350° F. (174° C.). These strips were bonded to the container end such that a portion of the strips projected into the pour hole opening therein. Exterior tape and interior film were then bonded circumjacent the opening in the container end in accordance with the teachings of U.S. Pat. No. 3,990,603, thereby enclosing the filaments projecting into the pour hole between the tape and film. The force required to remove completely the exterior tape from the can end was then measured on an "Instron" tester, as described above. Using a peel angle of 130°, that is, the top of the can end and the exterior tape defining an angle of approximately 50°, removal force in a number of runs was found to average approximately 49 pounds (22.5 kg).

EXAMPLE 2

The procedure of Example 1 was employed in several additional runs with the exception that the polyester filaments were not primed with the polycarbodiimide primer. The force required to remove the exterior tape where unprimed filaments were employed was found to average 48 pounds (22 kg).

EXAMPLE 3

The procedure of Example 1 was employed to bond eight pre-primed 1000 Denier polyester yarns to a 0.5 mil (13 micrometer) polyethylene terephthalate film. The force required to remove the tape using this thinner substrate is was found to average about 45 pounds (21 kg) in a number of runs.

EXAMPLE 4

The procedure of Example 4 was employed to bond eight un-primed 1000 Denier polyester yarns to a 0.5 mil (13 micrometer) polyester film. The force to remove the exterior tape from the can end was measured as in Example 1, and found to average 41 pounds (19 kg).

EXAMPLE 5

Eight 1000 Denier polyethylene terephthalate yarns were positioned adjacent one another and coated with "Dyvax PB-722" adhesive as in Example 1. As in Example 1, adhesive coated filaments were bonded to a container end so that they protruded into the pour opening. Exterior tapes and interior sheet materials were bonded to the container end enclosing the filaments between the exterior tape and interior sheet material in the area of the container opening and on the underside of the container end portion adjacent the following edge of the pour hole. The force required to remove the filament from the can end by exerting removal force on the exterior tape was then measured and found to average about 40 pounds (18 kg) in a number of runs.

EXAMPLE 6

Polyethylene hot melt adhesive coated polyethylene terephthalate yarns commercially available from Sesame Industries under the trade designation "Sesame" were employed as the retentionability increasing improvement herein. A 4 in. (10 cm)×¼ (0.6 cm) sample of the "Sesame" yarns was applied to a previously heated (to 174° C.) container end after which the exterior tape and interior sheet material were applied as in Example 1–4 above. The force required to remove the exterior tape (measured as described above) averaged 26 pounds (12 kg).

EXAMPLE 7

Ethylene vinyl acetate hot melt adhesive coated polyethylene terephthalate yarns commercially available from the H. B. Fuller Company under the trade designation "String King" were employed in the improvement herein using the procedure of Examples 22 through 25. The force required to remove the top tape from the container end averaged 26 pounds (12 kg) over a number of experimental runs.

What is claimed is:

1. An end portion for a container, said end portion being of the type having a closure system thereon comprising an exterior tape removably secured to the top of said end portion over a pour hole in said end portion, wherein the improvement comprises a non-metallic flexible film having a plurality of flexible yarns thereon, said film having a first end portion and a second end portion, wherein said first end portion is bonded to the underside of said container end portion and said second end portion is bonded to the underside of said tape in the area of said pour hole.

2. An improvement according to claim 1 wherein the total Denier of said yarns falls in the range of about 250 to 8,000.

3. An improvement according to claim 1 wherein said closure system further comprises an interior sheet material secured to the underside of said container end portion.

4. An improvement according to claim 3 wherein the total Denier of said yarns falls in the range of about 250 to about 8,000.

5. In a hand operable easy opening closure system of the type wherein a flexible exterior tape and interior sheet material are employed to removably seal a preformed opening in an end portion of a container, the improvement comprising a non-metallic flexible film having a first end portion and a second end portion, said film having a plurality of non-metallic flexible yarns thereon, the total Denier of said yarns falling in the range of about 1000 to about 8,000, said first end portion being bonded to the underside of said container end portion and said second end portion is bonded to said exterior tape and to said interior sheet material.

6. An end portion for a container, said end portion being of the type having a closure system thereon comprising an exterior tape removably secured to the top of said end portion over a pour hole, wherein the improvement comprises means for restricting separation of said closure system from said end portion comprising a non-metallic, tough, shear-resistant, flexible film having a first end portion and a second end portion, wherein said first end portion is bonded to the underside of said container end portion and said second end portion is bonded to the underside of said tape in the area of said pour hole.

7. An improvement according to claim 6 wherein said closure system further comprises an interior sheet material secured to the underside of said container end portion.

* * * * *